US011136814B1

(12) United States Patent
Diccianni

(10) Patent No.: US 11,136,814 B1
(45) Date of Patent: Oct. 5, 2021

(54) CLEANROOM PASS-THRU CHAMBER AND METHOD OF CONSTRUCTION

(71) Applicant: Laminar Flow, Inc., Ivyland, PA (US)

(72) Inventor: Eric Diccianni, North Wales, PA (US)

(73) Assignee: LAMINAR FLOW INC., Ivyland, PA (US)

( * ) Notice: Subject to any disclaimer, the term of this patent is extended or adjusted under 35 U.S.C. 154(b) by 0 days.

(21) Appl. No.: 16/936,020

(22) Filed: Jul. 22, 2020

(51) Int. Cl.
*E05G 7/00* (2006.01)
*B01L 1/04* (2006.01)

(52) U.S. Cl.
CPC ..... *E05G 7/005* (2013.01); *B01L 1/04* (2013.01)

(58) Field of Classification Search
CPC .... B01L 1/04; E04B 2002/7498; F24F 3/163; C12M 37/00; E04H 3/08; E05G 7/005; E06B 7/32
See application file for complete search history.

(56) References Cited

U.S. PATENT DOCUMENTS

2011/0053486 A1* 3/2011 Holtz ..... C12M 37/00 454/187
2013/0086860 A1* 4/2013 Solomon ..... E04B 2/7453 52/243.1
2016/0010884 A1* 1/2016 Holtz ..... B01L 1/04 454/187
2018/0043347 A1* 2/2018 Holtz ..... E04H 5/02

* cited by examiner

*Primary Examiner* — Andrew J Triggs
(74) *Attorney, Agent, or Firm* — Panitch Schwarze Belisario & Nadel LLP

(57) ABSTRACT

A method of constructing a cleanroom pass-thru chamber includes bending a single sheet of material into a monolithic frame having a first side, an opposing second side, a third side extending between the first and second sides, an open front end and an open rear end. The first side defines a first lip at a free end thereof and the second side defines a second lip at a free end thereof. The monolithic frame is bent to form four coved internal corners. The first lip and the second lip define an open portion therebetween. A first plate is attached to the two opposing lips and extends therebetween, closing the open portion of the monolithic frame, thereby forming an inner shell. The inner shell is positioned within, and attached to, an outer frame.

20 Claims, 3 Drawing Sheets

CLEANROOM PASS-THRU CHAMBER AND METHOD OF CONSTRUCTION

BACKGROUND OF THE DISCLOSURE

The present disclosure is generally directed to a cleanroom pass-thru chamber.

A cleanroom is a controlled environment, contained space that has a low, or controlled, level of contaminants/pollutants such as dust, airborne microbes, aerosol particles, and chemical vapors. A cleanroom pass-thru chamber is an enclosed chamber with a door on a cleanroom side and at least one other door on another side. The pass-thru internal chamber operates as a vessel for the transfer of materials between the cleanroom and another space while minimizing contaminant transfer to help maintain the cleanroom environment. Accordingly, it is imperative to maintain the cleanliness of the pass-thru internal chamber. One hotspot for trapping and accumulating of dust, germs, other contaminants or a combination thereof within a pass-thru chamber is along the sharp, i.e., generally 90°, corners of the chamber. Therefore, pass-thru chambers may include coved, i.e., rounded, corners, which are more easily accessible for cleaning, e.g., such as by manual/hand cleaning of the corners.

One drawback of conventional cleanroom pass-thru chambers employing coved corners is that the chamber is first formed in a conventional manner by bead welding adjacent sides of the chamber together, thereby forming a sharp corner, and, thereafter, rounding out the welded corner to form the coved corner. Such a manufacturing method is inefficient and costly.

Accordingly, it would be advantageous to develop a streamlined manufacturing process for cleanroom pass-thru chambers employing coved corners within the internal chamber.

BRIEF SUMMARY OF THE DISCLOSURE

Briefly stated, one aspect of the present disclosure is directed to a method of constructing a cleanroom pass-thru chamber including the steps of: (i) bending a single sheet of material into a monolithic frame having a first side, an opposing second side, a third side extending between the first and second sides, an open front end and an open rear end, the first side defining a first lip at a free end thereof and the second side defining a second lip at a free end thereof, the first lip and the first side being bent to have a first coved corner therebetween, the first side and the third side being bent to have a second coved corner therebetween, the third side and the second side being bent to have a third coved corner therebetween, the second side and the second lip being bent to have a fourth coved corner therebetween, and the first lip and the second lip defining an open portion therebetween; (ii) attaching a first plate to the first lip and to the second lip, the plate extending, and closing the open portion of the monolithic frame, therebetween, and, in turn, forming an inner shell having a continuous periphery; (iii) positioning the inner shell within an outer frame, the outer frame having an open front end and an open rear end; (iv) attaching the inner shell to the outer frame; and (v) attaching at least one of a front door to the open front end of the outer frame and a rear door to the open rear end of the outer frame.

Briefly stated, another aspect of the present disclosure is directed to a cleanroom pass-thru chamber including and inner shell and an outer wrapper. The inner shell includes a single sheet of material bent into a monolithic frame having a first side, an opposing second side, a third side extending between the first and second sides, an open front end and an open rear end. The first side defines a first lip at a free end thereof and the second side defines a second lip at a free end thereof. The first lip and the first side are bent to have a first coved corner therebetween, the first side and the third side are bent to have a second coved corner therebetween, the third side and the second side are bent to have a third coved corner therebetween, the second side and the second lip are bent to have a fourth coved corner therebetween, and the first lip and the second lip define an open portion therebetween. A first plate is attached to the first lip and to the second lip, the plate extending, and closing the open portion of the monolithic frame, therebetween, such that the inner shell defines a continuous periphery. The outer wrapper includes an outer frame having an open front end and an open rear end. The inner shell is positioned within, and attached to, the outer wrapper. At least one of a front door is attached to the open front end of the outer wrapper and a rear door is attached to the open rear end of the outer wrapper.

BRIEF DESCRIPTION OF THE DRAWINGS

The following description of aspects of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
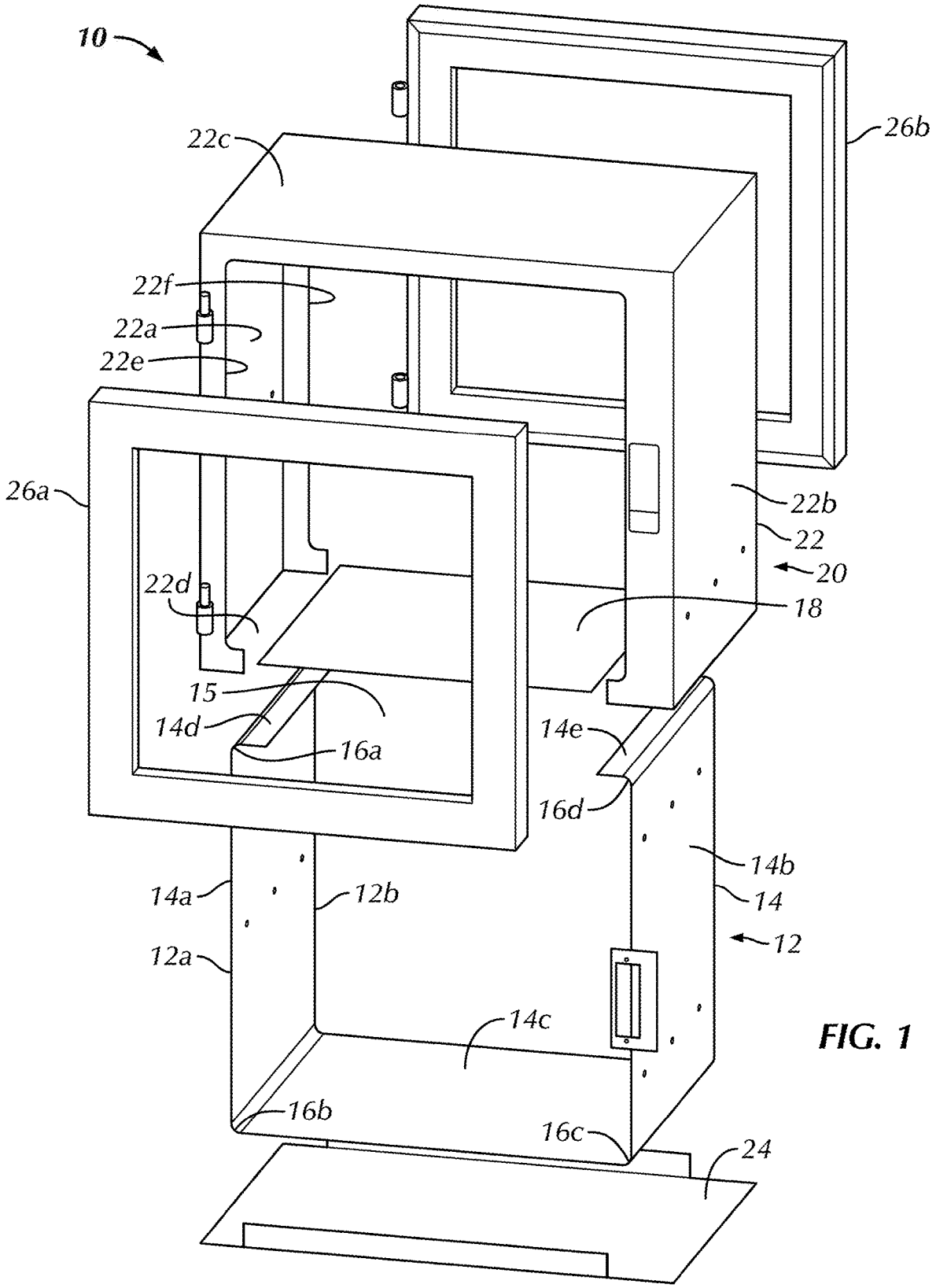
FIG. 1 is a front and right side perspective exploded view of a cleanroom pass-thru chamber according to the present disclosure.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the pass-thru chamber, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
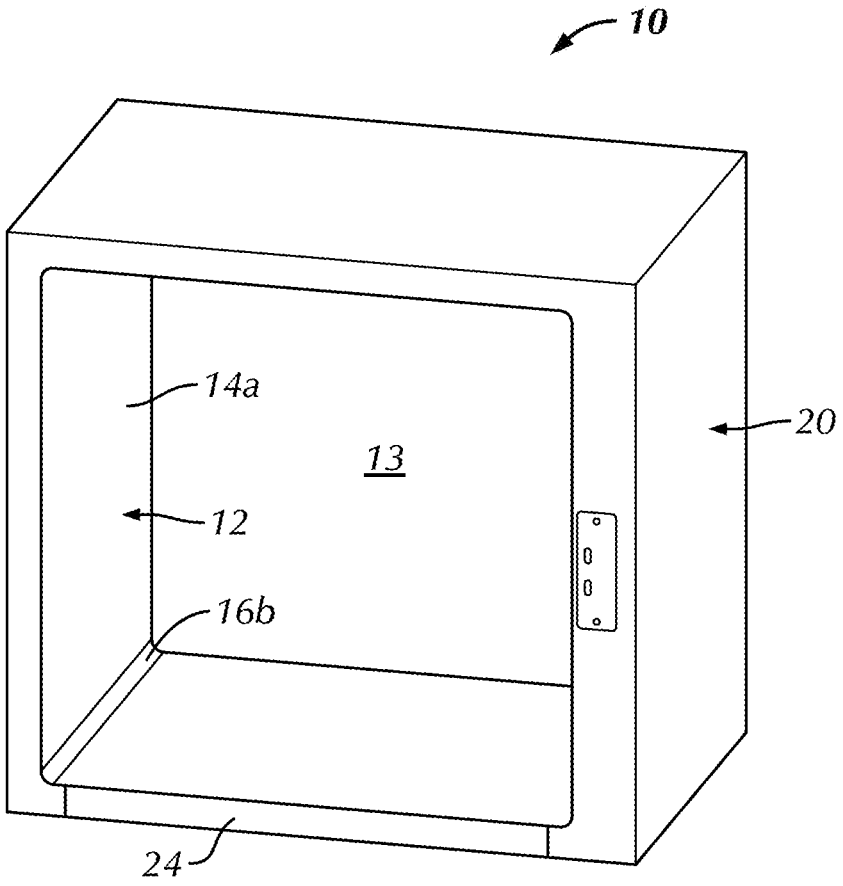
FIG. 2 is a front and right side perspective assembled view of the cleanroom pass-thru chamber of FIG. 1, with doors removed.
Figure 3:
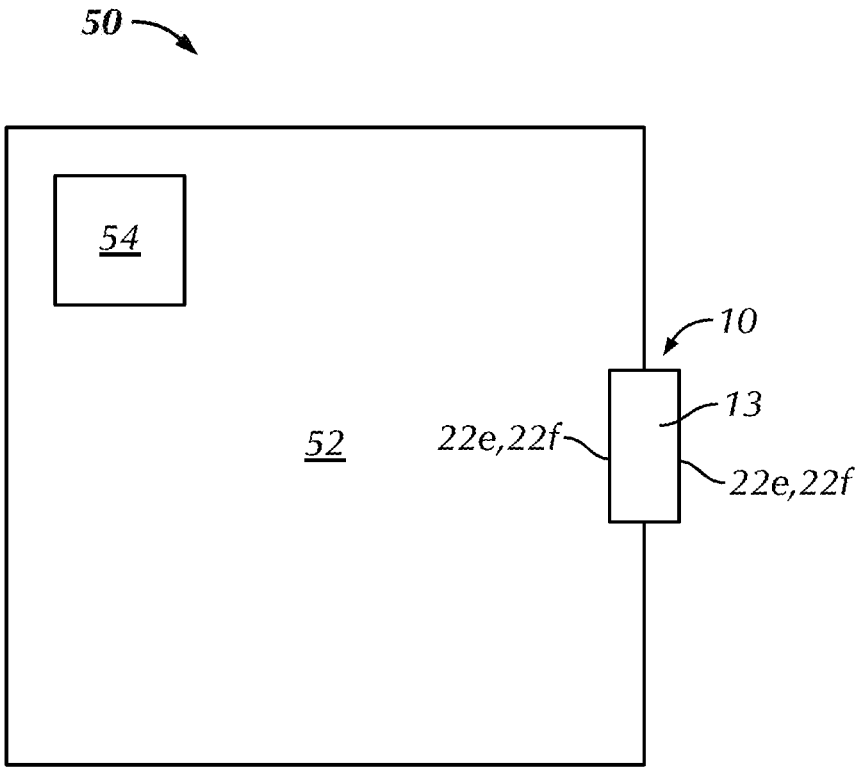
FIG. 3 is a schematic view of a cleanroom having a cleanroom pass-thru chamber installed.

Referring to the drawings in detail, wherein like numerals indicate like elements throughout, there is shown in FIGS. 1-3, a cleanroom pass-thru chamber 10, intended for use with a cleanroom 50 (FIG. 3) (as will be described in further detail below). The cleanroom pass-thru chamber 10 includes an outer wrapper 20 and an inner shell 12. The inner shell 12 includes a monolithic frame 14 formed from a single sheet of material, e.g., a single sheet of metal or the like. The single sheet of material is bent to form a first side 14*a*, an opposing second side 14*b*, and a third side 14*c* extending between the first and second sides. Formation of the first side 14*a* includes bending the single sheet of material to form a first lip 14*d* at a free end of the first side 14*a*. Formation of the second side 14*b* also includes bending the single sheet of material to form a second lip 14*e* at a free end of the second side 14*b*. The first lip 14*d* and the second lip 14*e* define an open portion 15 therebetween. The bending of the frame 14 is typically accomplished using a standard manual or automatic sheet metal bending machine as is well understood by those of ordinary skill in the art. Alternatively, the bending of the frame 14 could be accomplished by hand.

In the illustrated configuration, the first side 14*a* is a substantially vertically oriented left side of the monolithic frame 14 and the opposing second side 14*b* is a substantially parallel right side of the monolithic frame 14, but the disclosure is not so limited. The third side 14*c* is a substantially lateral base side of the monolithic frame 14, extending substantially perpendicularly between the first and second sides 14*a*, 14*b* and the first and second lips 14*d*, 14*e*, positioned at the respective upper ends of the first and second sides 14*a*, 14*b*, are each oriented substantially parallel with the third side 14*c*, but the disclosure is also not so limited. As one alternative configuration, for example, the third side 14*c* may be a substantially lateral top end and the first and second lips 14*d*, 14*e* may be positioned at respective base ends of the first and second sides 14*a*, 14*b*.

The single sheet of material is purposefully bent to form a first coved corner 16*a*, i.e., a rounded/concave corner having a radius, between the first lip 14*d* and the first side 14*a*, a second coved corner 16*b* between the first side 14*a* and the third side 14*c*, a third coved corner 16*c* between the third side 14*c* and the second side 14*b* and a fourth coved corner 16*d* between the second side 14*b* and the second lip 14*e*. In one configuration, the coved corners 14*a-d* each define a one-half inch (½") radius, but the disclosure is not so limited. Coved corners are advantageous over sharp edge corners in a cleanroom pass-thru chamber as sharp edge corners are more susceptible to trapping contaminants, whereas coved corners are more easily accessible to remove contaminants during a cleaning process. Forming the monolithic frame 14 of a single sheet of material purposefully bent to form coved corners between the adjacent sides/lips is particularly advantageous from a manufacturing efficiency and cost perspective. That is, the monolithic frame 14 is formed in a single stage bending process, rather than a multi-stage process involving welding or otherwise attaching sides together, and, thereafter rounding out the corners. Eliminating manufacturing steps also eliminates otherwise unnecessary machinery while increasing output.

After formation of the monolithic frame 14, a first plate 18, e.g., a metal plate or the like, is permanently attached to the first lip 14*d* and to the second lip 14*e*. As should be understood, permanent attachment/securement indicates that the components are not disconnectable/separable/removable without causing damage to at least one of the components or otherwise to the cleanroom pass-thru chamber 10. For example, without limitation, the first plate 18 may be placed upon the first and second lips 14*d*, 14*e*, forming respective butt joints therebetween, and the first plate 18 may be welded, e.g., continuously welded, i.e., spanning substantially the entire length of the joint, to each of the first and second lips 14*d*, 14*e* along the respective lengths thereof. The first plate 18 extends between the first and second lips 14*d*, 14*e*, closing the open portion 15 of the monolithic frame 14, and, in turn, forming the inner shell 12 having a continuous periphery formed of the sides 14*a*, 14*b*, 14*c* and 18 defining an internal chamber 13. As shown, the inner shell 12 (and the internal chamber 13) includes an open front end 12*a* and an open rear end 12*b*, but the disclosure is not so limited. That is, the inner shell 12 (and the internal chamber 13) may define only one open end or more than two open ends. Additionally, or alternatively, where the inner shell 12 includes two open ends, the open ends need not oppose one another, but may, for example, be ends adjacent to one another, such as, for example, perpendicular to one another.

The inner shell 12 is thereafter positioned within an outer frame 22 of the outer wrapper 20. The outer frame 22 includes a first side 22*a*, an opposing second side 22*b*, a third side 22*c* extending therebetween and an opposing open end 22*d*. In the illustrated embodiment, the first side 22*a* of the outer frame 22 is a substantially vertically oriented left side of the outer frame 22 and the opposing second side 22*b* is a substantially parallel right side of the outer frame 22, but the disclosure is not so limited. The third side 22*c* is a substantially lateral top side of the outer frame 22, extending substantially perpendicularly between the first and second sides 22*a*, 22*b* and the opposing open end 22*d* is a base end, but the disclosure is also not so limited. As one alternative configuration, for example, the third side 22*c* may be a substantially lateral base side and the opposing open end 22*d* may be an open top end. In the illustrated embodiment, the outer frame 22 also includes an open front end 22*e* and an open rear end 22*f*, but the disclosure is not so limited. As should be understood, the outer frame 22 includes open end(s) complementing the open end(s) of the inner shell 12. That is, if the inner shell 12 defines only one open end, more than two open ends, and/or differently oriented/positioned open ends, the outer frame 22 will define corresponding open ends.

The open end 22*d* is dimensioned relative to the inner shell 12 to receive the inner shell 12 therethrough when the inner shell 12 is positioned within the outer frame 22. The inner shell 12 is positioned within the outer frame 22 such that the open front end 22*e* of the outer frame 22 is in registry with the open front end 12*a* of the inner shell 12 and the open rear end 22*f* of the outer frame 22 is in registry with the open rear end 12*b* of the inner shell 12. Afterward, the inner shell 12 is permanently secured to the outer frame 22. In one configuration, the outer frame 22 may be constructed of metal. Accordingly, where the inner shell 12 is also constructed of metal, the inner shell 12 may be welded to the outer frame 22. For example, an outer peripheral edge of the inner shell 11 may be welded, e.g., continuously welded, to an inner peripheral edge of the outer frame 22. As should be understood by those of ordinary skill in the art, however, the inner shell 12 may be attached to the outer frame 22 via other methods currently known, or that later become know, in order to secure the inner shell 12 within the outer frame 22.

The outer wrapper 20 further includes a second plate 24. After the inner shell 12 is positioned within the outer frame 22, the second plate 24 is permanently attached to the outer frame 22 to close the open end 22*d* thereof, such that the outer wrapper 20 obtains a continuous outer periphery (see FIG. 2). For example, the second plate 24 may be a metallic plate and may be welded, e.g., continuously welded, to the base end 22*d* of the outer frame 22.

At least one door is attached to the outer wrapper 20 to at least one of the open front and rear ends 22*e*, 22*f* thereof. In the illustrated embodiment of FIG. 1, a front door 26*a* is attached to the open front end 22*e* of the outer wrapper 20 and a rear door 26*b* is attached to the open rear end 22*e* of the outer wrapper 20, in a manner well understood by those of ordinary skill in the art, thereby enclosing the inner chamber 13. As shown, the doors 26*a*, 26*b* may take the form of framed doors having transparent windows, e.g., clear safety glass, lexan or plexiglass, to permit visibility into the inner chamber 13, but the disclosure is not so limited. In a configuration where the outer wrapper 20 includes more than two open ends, a corresponding number of doors may be respectively attached thereto. As should be understood, the pass-thru chamber 10 may include at least one filter (not shown), e.g., a high-efficiency particulate air ("HEPA") filter, configured to filter the air within the inner chamber 13. As also should be understood, the pass-thru chamber 10 may include locks (mechanical, electrical or a combination thereof) (not shown), known by those of ordinary skill in the art, for the front and rear doors 26*a*, 26*b*, configured to allow only one door to open at a time. The locks may be configured to prevent opening of a door 26*a*, 26*b* for a predetermined period of time from the previous door opening, wherein the predetermined period of time corresponds to a time interval sufficient for the filter to clean the air within the inner chamber 13.

As shown schematically in FIG. 3, a cleanroom 50 is defined by a contained space 52 having an enclosed periphery. Portions of the periphery of the space 52 may be selectively enclosed, such as by door(s) (not shown). At least one filter 54, e.g., a high-efficiency particulate air ("HEPA") filter, is employed in the cleanroom 50 to reduce contaminants in air delivered to the contained space 52. The cleanroom pass-thru chamber 10 is installed along the periphery of the contained space 52 wherein one of the front end 22*e* and the rear end 22*f* of the outer frame 22 faces an interior of the contained space 52 and the other of the front end 22*e* and the rear end 22*f* of the outer frame 22 faces an exterior of the contained space 52. Accordingly, articles (not shown) may be transferred between the interior and exterior of the container space 52 via the internal chamber 13 of the cleanroom pass-thru chamber 10.

It will be appreciated by those skilled in the art that changes could be made to the embodiments described above without departing from the broad inventive concepts thereof. It is understood, therefore, that this invention is not limited to the particular embodiments disclosed, but it is intended to cover modifications within the spirit and scope of the present disclosure, as set forth in the appended claims.

I claim:

1. A method of constructing a cleanroom pass-thru chamber comprising the steps of:

bending a single sheet of material into a monolithic frame having a first side, an opposing second side, a third side extending between the first and second sides, an open front end and an open rear end, the first side defining a first lip at a free end thereof and the second side defining a second lip at a free end thereof, the first lip and the first side being bent to have a first coved corner therebetween, the first side and the third side being bent to have a second coved corner therebetween, the third side and the second side being bent to have a third coved corner therebetween, the second side and the second lip being bent to have a fourth coved corner therebetween, and the first lip and the second lip defining an open portion therebetween;

attaching a first plate to the first lip and to the second lip, the plate extending, and closing the open portion of the monolithic frame, therebetween, and, in turn, forming an inner shell having a continuous periphery;

positioning the inner shell within an outer frame, the outer frame having an open front end and an open rear end;

attaching the inner shell to the outer frame; and attaching at least one of a front door to the open front end of the outer frame and a rear door to the open rear end of the outer frame.

2. The method of claim 1, wherein the first side of the monolithic frame is a left side and the free end thereof is a free upper end, the opposing second side of the monolithic frame is a substantially parallel right side and the free end thereof is an opposing free upper end, and the third side of the monolithic frame is a substantially lateral base side extending therebetween.

3. The method of claim 1, wherein the monolithic frame is a metallic frame, and the first plate is a metallic plate.

4. The method of claim 3, wherein the step of attaching the first plate to the first lip and to the second lip comprises welding the first plate to the first lip and welding the first plate to the second lip.

5. The method of claim 1, wherein the outer frame further includes a first side, an opposing second side, a third side extending between the first and second sides of the outer frame, and an opposing open base end.

6. The method of claim 5, wherein the positioning step comprises inserting the inner shell into the outer frame via the open base end thereof.

7. The method of claim 5, further comprising the step of attaching a second plate to the outer frame to close the open base end thereof, and, in turn, forming an outer wrapper having a continuous periphery.

8. The method of claim 7, wherein the outer frame is a metallic frame and the second plate is a metallic plate.

9. The method of claim 8, wherein the step of attaching the second plate to the outer frame comprises welding the second plate to the outer frame.

10. The method of claim 1, wherein the step of attaching at least one of the front door to the open front end of the outer frame and the rear door to the open rear end of the outer frame comprises attaching the front door to the open front end of the outer frame and attaching the rear door to the open rear end of the outer frame.

11. The method of claim 1, wherein the step of attaching the inner shell to the outer frame comprises welding an outer peripheral edge of the inner shell to an inner peripheral edge of the outer frame.

12. A cleanroom pass-thru chamber comprising:

an inner shell comprising:

a single sheet of material bent into a monolithic frame having a first side, an opposing second side, a third side extending between the first and second sides, an open front end and an open rear end, the first side defining a first lip at a free end thereof and the second side defining a second lip at a free end thereof, the first lip and the first side being bent to have a first coved corner therebetween, the first side and the third side being bent to have a second coved corner therebetween, the third side and the second side being bent to have a third coved corner therebetween, the second side and the second lip being bent to have a fourth coved corner therebetween, and the first lip and the second lip defining an open portion therebetween;

a first plate attached to the first lip and to the second lip, the plate extending, and closing the open portion of the monolithic frame, therebetween, such that the inner shell defines a continuous periphery;

an outer wrapper comprising:

an outer frame having an open front end and an open rear end; and the inner shell being positioned within, and attached to, the outer wrapper; and at least one of a front door attached to the open front end of the outer wrapper and a rear door attached to the open rear end of the outer wrapper.

13. The cleanroom pass-thru chamber of claim 12, wherein the monolithic frame is a metallic frame, and the first plate is a metallic plate.

14. The cleanroom pass-thru chamber of claim 13, wherein the first plate is welded to each of the first lip and the second lip.

15. The cleanroom pass-thru chamber of claim 12, wherein the outer frame further includes a first side, an opposing second side, a third side extending between the first and second sides and an opposing open base end.

16. The cleanroom pass-thru chamber of claim 15, wherein the outer wrapper further comprises a second plate attached to the outer frame to close the open base end thereof, such that the outer wrapper defines a continuous periphery.

17. The cleanroom pass-thru chamber of claim 16, wherein the outer frame is a metallic frame and the second plate is a metallic plate, and the second plate is welded to the outer frame.

18. The cleanroom pass-thru chamber of claim 12, further comprising the front door attached to the open front end of the outer wrapper and the rear door attached to the open rear end of the outer wrapper.

19. The cleanroom pass-thru chamber of claim 12, wherein an outer peripheral edge of the inner shell is welded to an inner peripheral edge of the outer frame.

20. A cleanroom comprising:

a contained space having a periphery;

at least one filter configured to reduce contaminants in air delivered to the contained space; and the cleanroom pass-thru chamber of claim 12, installed along the periphery of the contained space wherein one of the front end and the rear end of the outer frame faces an interior of the contained space and an other of the front end and the rear end of the outer frame faces an exterior of the contained space.

* * * * *